US010127869B2

(12) United States Patent
Shin et al.

(10) Patent No.: US 10,127,869 B2
(45) Date of Patent: Nov. 13, 2018

(54) TIMING CONTROLLER, DISPLAY APPARATUS INCLUDING THE SAME AND METHOD OF DRIVING THE DISPLAY APPARATUS

(71) Applicant: SAMSUNG DISPLAY CO., LTD., Yongin-si, Gyeonggi-Do (KR)

(72) Inventors: Dong-Hwa Shin, Yongin-si (KR); Jung-Won Kim, Seoul (KR); Gi-Geun Kim, Seoul (KR); Jae-Sung Bae, Suwon-si (KR); Nam-Gon Choi, Yongin-si (KR); Bong-Gyun Kang, Suwon-si (KR)

(73) Assignee: SAMSUNG DISPLAY CO., LTD., Yongin-Si, Gyeonggi-Do (KR)

( * ) Notice: Subject to any disclaimer, the term of this patent is extended or adjusted under 35 U.S.C. 154(b) by 177 days.

(21) Appl. No.: 15/041,851

(22) Filed: Feb. 11, 2016

(65) Prior Publication Data

US 2017/0053612 A1 Feb. 23, 2017

(30) Foreign Application Priority Data

Aug. 17, 2015 (KR) ..... 10-2015-0115609

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 2310/08* (2013.01)

(58) Field of Classification Search
CPC . G09G 2310/08; G09G 3/3406; G09G 3/3648
USPC ..... 345/87, 99
See application file for complete search history.

(56) References Cited

U.S. PATENT DOCUMENTS

2012/0154428 A1* 6/2012 Barnhoefer ..... G06T 11/001 345/596
2012/0169720 A1* 7/2012 Moh ..... H04N 13/0025 345/419
2014/0071120 A1* 3/2014 Lee ..... G06T 15/005 345/419

FOREIGN PATENT DOCUMENTS

KR 1020100007077 1/2010

* cited by examiner

*Primary Examiner* — Roy P Rabindranath
(74) *Attorney, Agent, or Firm* — F. Chau & Associates, LLC.

(57) ABSTRACT

A timing controller for a display apparatus includes a polarity comparison part and a compensation part. The polarity comparison part compares a first polarity of a first data voltage with a second polarity of a second data voltage, the first data voltage corresponding to a first pixel in a first frame and generated based on a first gamma voltage, the second data voltage corresponding to the first pixel in a second frame and generated based on a second gamma voltage. The compensation part compensates the second data voltage based on a first look-up table, if the first polarity is the same as the second polarity, and compensates the second data voltage based on a second look-up table, if the first polarity is different from the second polarity.

16 Claims, 6 Drawing Sheets

TIMING CONTROLLER, DISPLAY APPARATUS INCLUDING THE SAME AND METHOD OF DRIVING THE DISPLAY APPARATUS

CROSS-REFERENCE TO RELATED APPLICATION

This application claims priority under 35 U.S.C. § 119 from, and the benefit of, Korean Patent Application No. 10-2015-0115609, filed on Aug. 17, 2015 in the Korean Intellectual Property Office (KIPO), the contents of which are herein incorporated by reference in their entirety.

BACKGROUND

1. Technical Field

Exemplary embodiments of the present inventive concept are directed to display devices, and more particularly to timing controllers, display apparatuses including the timing controllers and methods of driving the display apparatuses.

2. Discussion of the Related Art

A liquid crystal display (LCD) apparatus typically includes a first substrate that includes a pixel electrode, a second substrate that includes a common electrode, and a liquid crystal layer disposed between the first and second substrates. Voltages are applied to the pixel electrode and the common electrode to generate an electric field. Transmittance of light passing through the liquid crystal layer can be controlled by the electric field, and thus, a desired image can be displayed.

To enhance visibility of an LCD apparatus, a temporal gamma mixing (TGM) scheme can be employed that defines a frame set based on at least two frames and displays an image during one frame set period by combining at least one frame image having a grayscale higher than that of the original image and at least one frame image having a grayscale lower than that of the original image. However, a moving artifact and/or a flicker may appear on an LCD apparatus operating based on a TGM scheme.

In particular, in a TGM scheme, a voltage gap between high and low gamma voltages when a polarity remains same is different from a voltage gap between the high and low gamma voltages when the polarity is inverted.

SUMMARY

Exemplary embodiments of the present inventive concept can provide a timing controller capable of improving display quality.

Exemplary embodiments of the present inventive concept can provide a display apparatus that includes the timing controller.

Exemplary embodiments of the present inventive concept can provide a method of driving the display apparatus.

A timing controller according to an exemplary embodiment of the present inventive concept includes a polarity comparison part and a compensation part. The polarity comparison part is configured to compare a first polarity of a first data voltage with a second polarity of a second data voltage, the first data voltage corresponding to a first pixel in a first frame and generated based on a first gamma voltage, the second data voltage corresponding to the first pixel in a second frame and generated based on a second gamma voltage. The compensation part is configured to compensate the second data voltage based on a first look-up table if the first polarity is substantially the same as the second polarity, and compensate the second data voltage based on a second look-up table if the first polarity is different from the second polarity.

In an exemplary embodiment, a difference between the first data voltage and the compensated second data voltage is greater than a difference between the first data voltage and the second data voltage, if the second data voltage is compensated based on the first look-up table.

In an exemplary embodiment, a difference between the first data voltage and the compensated second data voltage is less than a difference between the first data voltage and the second data voltage, if the second data voltage is compensated based on the second look-up table.

In an exemplary embodiment, a luminance of an image based on the first gamma voltage is equal to or greater than a luminance of an image based on a reference gamma voltage, and a luminance of an image based on the second gamma voltage is equal to or less than the luminance of the image based on the reference gamma voltage.

In an exemplary embodiment, a composite gamma of the first and second gamma voltages is substantially the same as the reference gamma voltage.

In an exemplary embodiment, the first frame and the second frame are two consecutive frames.

In an exemplary embodiment, the polarity comparison part includes a frame counter configured to determine whether the second frame is an odd-numbered frame or an even-numbered frame.

In an exemplary embodiment, the frame counter determines that the first polarity is different from the second polarity if the second frame is the odd-numbered frame, and determines that the first polarity is the same as the second polarity if the second frame is the even-numbered frame.

A display apparatus according to an exemplary embodiment of the present inventive concept includes a display panel, a timing controller and a data driver. The display panel includes a first pixel. The timing controller includes a polarity comparison part and a compensation part. The polarity comparison part is configured to compare a first polarity of a first data voltage with a second polarity of a second data voltage, the first data voltage corresponding to a first pixel in a first frame, the second data voltage corresponding to the first pixel in a second frame. The compensation part is configured to compensate the second data voltage based on a first look-up table if the first polarity is substantially the same as the second polarity and compensate the second data voltage based on a second look-up table if the first polarity is different from the second polarity. The data driver is configured to output the first data voltage to the first pixel in the first frame and output the compensated second data voltage to the first pixel in the second frame.

In an exemplary embodiment, a difference between the first data voltage and the compensated second data voltage is greater than a difference between the first data voltage and the second data voltage, if the second data voltage is compensated based on the first look-up table.

In an exemplary embodiment, a difference between the first data voltage and the compensated second data voltage is less than a difference between the first data voltage and the second data voltage, if the second data voltage is compensated based on the second look-up table.

In an exemplary embodiment, the first data voltage was generated based on a first gamma voltage and the second data voltage was generated based on a second gamma voltage, a luminance of an image based on the first gamma voltage is equal to or greater than a luminance of an image based on a reference gamma voltage, and a luminance of an image based on the second gamma voltage is equal to or less than the luminance of the image based on the reference gamma voltage.

In an exemplary embodiment, a composite gamma of the first and second gammas is substantially the same as the reference gamma voltage.

In an exemplary embodiment, the first frame and the second frame are two consecutive frames.

In an exemplary embodiment, the polarity comparison part includes a frame counter configured to determine whether the second frame is an odd-numbered frame or an even-numbered frame.

In an exemplary embodiment, the frame counter determines that the first polarity is different from the second polarity, if the second frame is the odd-numbered frame, and determines that the first polarity is substantially the same as the second polarity, if the second frame is the even-numbered frame.

A method of driving a display apparatus according to an exemplary embodiment of the present inventive concept includes comparing a first polarity of a first data voltage with a second polarity of a second data voltage, the first data voltage corresponding to a first pixel in a first frame and generated based on a first gamma voltage, the second data voltage corresponding to the first pixel in a second frame and generated based on a second gamma voltage, compensating the second data voltage based on a first look-up table if the first polarity is substantially the same as the second polarity, and compensating the second data voltage based on a second look-up table if the first polarity is different from the second polarity, and outputting the compensated second data voltage to the first pixel in the second frame.

In an exemplary embodiment, a difference between the first data voltage and the compensated second data voltage is greater than a difference between the first data voltage and the second data voltage, if the second data voltage is compensated based on the first look-up table.

In an exemplary embodiment, a difference between the first data voltage and the compensated second data voltage is less than a difference between the first data voltage and the second data voltage, if the second data voltage is compensated based on the second look-up table.

In an exemplary embodiment, a luminance of an image based on the first gamma voltage is equal to or greater than a luminance of an image based on a reference gamma voltage and a luminance of an image based on the second gamma voltage is equal to or less than the luminance of the image based on the reference gamma voltage.

According to exemplary embodiments, data voltages are compensated based on different look-up tables depending on the comparison of polarities of a previous frame and a present frame to reduce the difference of response speed between each case. Thus, display quality of a display panel can be improved.

DETAILED DESCRIPTION OF EMBODIMENTS

Hereinafter, exemplary embodiments of the present inventive concept will be described in detail with reference to the accompanying drawings.

Figure 1:
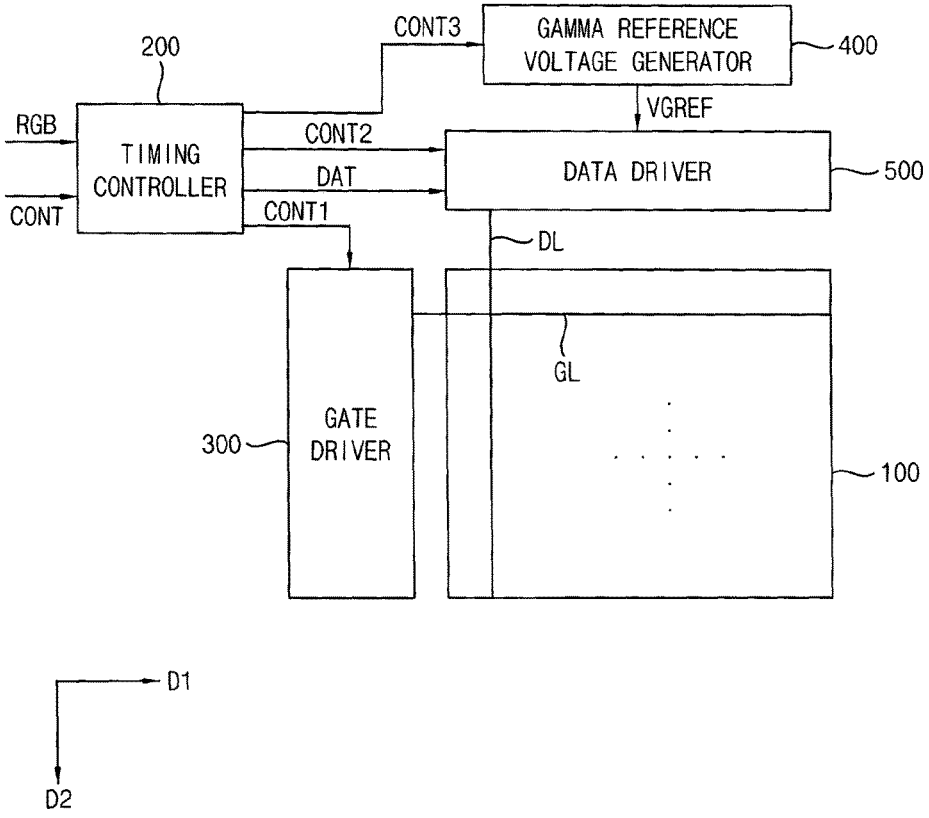
FIG. 1 is a block diagram of a display apparatus according to exemplary embodiments.

FIG. 1 is a block diagram of a display apparatus according to exemplary embodiments.

Referring to FIG. 1, a display apparatus includes a display panel 100 and a panel driver. The panel driver includes a timing controller 200, a gate driver 300, a gamma reference voltage generator 400 and a data driver 500.

The display panel 100 includes a display region for displaying an image and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 that crosses the first direction D1.

In some exemplary embodiments, the pixels include a switching element, a liquid crystal capacitor and a storage capacitor. The liquid crystal capacitor and the storage capacitor can be electrically connected to the switching element. The pixels can be arranged in a matrix configuration.

According to an embodiment, the timing controller 200 receives input image data RGB and an input control signal CONT from an external device. The input image data RGB includes red image data R, green image data G and blue image data B. The input control signal CONT includes a master clock signal and a data enable signal. The input control signal CONT further includes a vertical synchronizing signal and a horizontal synchronizing signal.

According to an embodiment, the timing controller 200 generates a first control signal CONT1 for controlling operations of the gate driver 300, a second control signal CONT2 for controlling operations of the data driver 500, a third control signal CONT3 for controlling operations of the gamma reference voltage generator 400, and a data signal DAT, based on the input image data RGB and the input control signal CONT.

The timing controller 200 generates the first control signal CONT1 based on the input control signal CONT, and outputs the first control signal CONT1 to the gate driver 300. According to an embodiment, the first control signal CONT1 included a vertical start signal and a gate clock signal.

The timing controller 200 generates the second control signal CONT2 based on the input control signal CONT, and outputs the second control signal CONT2 to the data driver 500. According to an embodiment, the second control signal CONT2 includes a horizontal start signal and a load signal.

The timing controller 200 generates the data signal DAT based on the input image data RGB. The timing controller 200 outputs the data signal DAT to the data driver 500. The data signal DAT may be substantially the same as the input image data RGB, or the data signal DAT may be generated by compensating the input image data RGB. For example, the timing controller 200 may selectively perform an image quality compensation, a spot compensation, an adaptive color correction (ACC), and/or a dynamic capacitance compensation (DCC) on the input image data RGB to generate the data signal DAT.

According to an embodiment, the timing controller 200 generates the third control signal CONT3 based on the input control signal CONT, and outputs the third control signal CONT3 to the gamma reference voltage generator 400.

The operations of the timing controller 200 to drive the display panel 100 will be described in detail with reference to FIGS. 5A, 5B, 6A and 6B.

According to an embodiment, the gate driver 300 generates gate signals for driving the gate lines GL in response to the first control signal CONT1 received from the timing controller 200. The gate driver 300 sequentially outputs the gate signals to the gate lines GL.

The gate driver 300 may be directly mounted on the display panel 100, or may be connected to the display panel 100 as part of a tape carrier package (TCP). Alternatively, the gate driver 300 may be integrated into the peripheral region of the display panel 100.

According to an embodiment, the gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

The gamma reference voltage generator 400 may be disposed in the timing controller 200, or may be disposed in the data driver 500.

According to an embodiment, the data driver 500 receives the second control signal CONT2 and the data signal DAT from the timing controller 200, and receives the gamma reference voltage VGREF from the gamma reference voltage generator 400. The data driver 500 converts the data signal DAT to analog data voltages based on the gamma reference voltage VGREF. The data driver 500 outputs the data voltages to the data lines DL.

The data driver 500 may be directly mounted on the display panel 100, or may be connected to the display panel 100 as part of a tape carrier package (TCP). Alternatively, the data driver 500 may be integrated into the peripheral region of the display panel 100.

Figure 2:
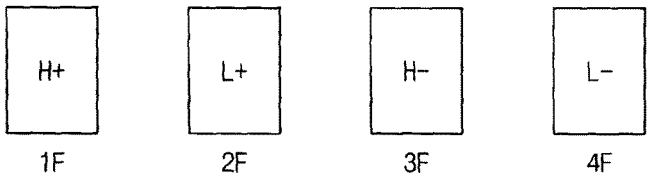
FIG. 2 illustrates data voltages outputted to a first pixel included in a display apparatus according to exemplary embodiments in each frame.
Figure 3:
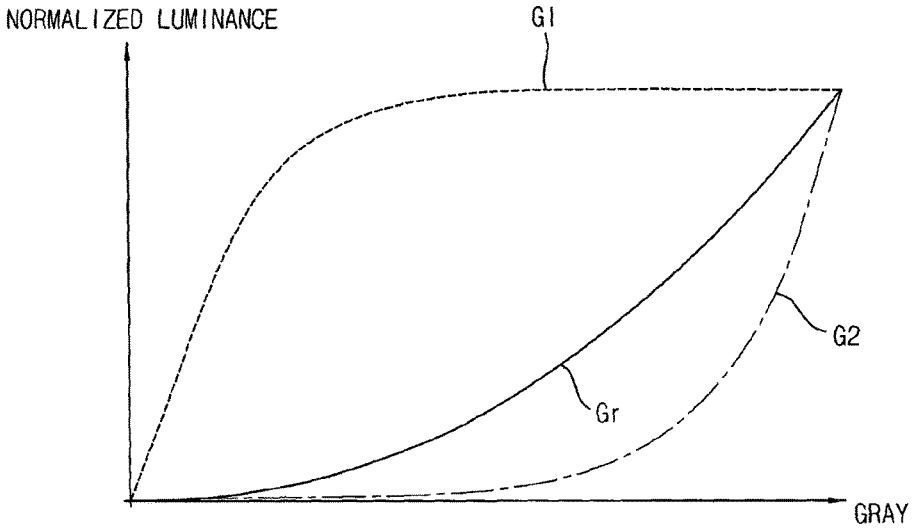
FIG. 3 is a graph of gamma curves of a display apparatus according to exemplary embodiments.

FIG. 2 illustrates data voltages outputted to a first pixel included in a display apparatus according to exemplary embodiments in each frame. FIG. 3 is a graph illustrating gamma curves of a display apparatus according to exemplary embodiments.

Referring to FIGS. 1 and 2, the display panel 100 includes a first pixel. A first data voltage generated based on a first gamma voltage is outputted to the first pixel in a first frame 1F. A second data voltage generated based on a second gamma voltage is outputted to the first pixel in a second frame 2F. A third data voltage generated based on the first gamma voltage is outputted to the first pixel in a third frame 3F. A fourth data voltage generated based on the second gamma voltage is outputted to the first pixel in a fourth frame 4F. The first gamma voltage may be a high gamma H, and the second gamma voltage may be a low gamma L. The first through fourth frames 1F~4F are sequentially arranged.

The first and second data voltages may have a first polarity. The third and fourth data voltages may have a second polarity different from the first polarity. The first polarity may be a positive (+) polarity, and the second polarity may be a negative (−) polarity. Alternatively, the first polarity may be the negative (−) polarity, and the second polarity may be the positive (+) polarity. Alternatively, the first through fourth data voltages may have the first polarity. In other words, the polarities of the data voltages outputted to the first pixel may be inverted every two or four frames.

Referring to FIGS. 2 and 3, a luminance of an image based on a first gamma G1 may be equal to or greater than a luminance of an image based on a reference gamma Gr, and a luminance of an image based on a second gamma G2 may be equal to or less than the luminance of the image based on the reference gamma Gr. In other words, the first gamma G1 may be the high gamma H, and the second gamma G2 may be the low gamma L. A composite gamma of the first and second gammas G1 and G2 may be substantially the same as the reference gamma Gr.

According to embodiments, a pixel operating based on the reference gamma Gr displays an image having a luminance that is substantially the same as a target luminance. A pixel operating based on the first gamma G1 displays an image having a luminance that is higher than the target luminance, and a pixel operating based on the second gamma G2 displays an image having a luminance that is lower than the target luminance.

Thus, according to embodiments, one frame set includes at least two frames, and one output image is displayed on the display panel 100 during the one frame set. The one output image includes at least two frame images, each of which is displayed on the display panel 100 during one of the at least two frames. In other words, the one output image can be a combination of the at least two frame images.

For example, a first partial image based on the first gamma G1 can be displayed on the first pixel in the first frame F1, and a second partial image based on the second gamma G2 can be displayed on the first pixel in the second frame F2. In this case, a first image is a combination of the first and second partial images. The first image is based on the reference gamma Gr, and has a first reference luminance. A first luminance of the first partial image may be equal to or greater than the first reference luminance, and a second luminance of the second partial image may be equal to or less than the first reference luminance.

Similarly, a third partial image based on the first gamma G1 is displayed on the first pixel in the third frame F3, and a fourth partial image based on the second gamma G2 is displayed on the first pixel in the fourth frame F4. In this case, a second image is a combination of the third and fourth partial images. The second image is based on the reference gamma Gr, and has a second reference luminance. A third luminance of the third partial image may be equal to or greater than the second reference luminance, and a fourth luminance of the fourth partial image may be equal to or less than the second reference luminance.

In other words, the reference gamma Gr can be generated based on the first and second gammas G1, G2. This is a temporal gamma mixing (TGM) scheme. In a TGM scheme, side visibility and transmittance can be improved.

Figure 4:
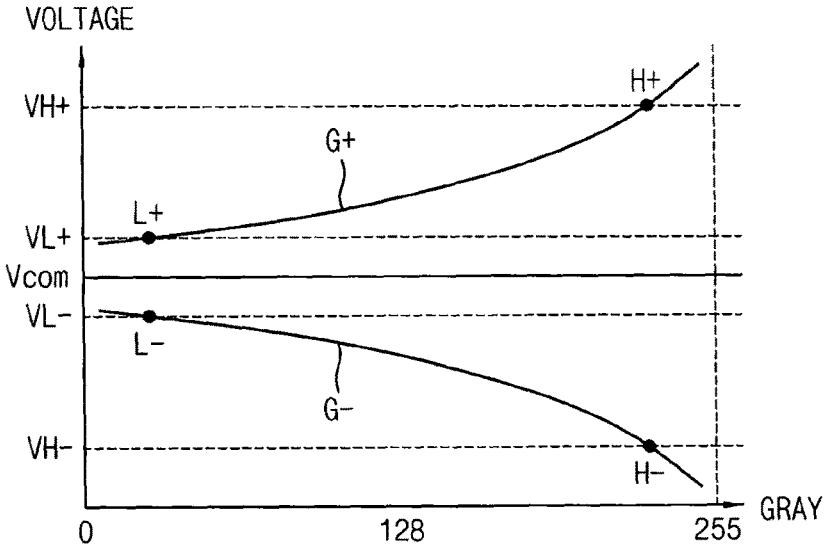
FIG. 4 (RELATED ART)
FIG. 4 is a graph of gamma curves of a display apparatus according to related art.

FIG. 4 is a graph of gamma curves of a display apparatus according to related art.

FIG. 4 depicts a data voltage VH+ generated based on a high gamma H and having a positive (+) polarity, a data voltage VL+ generated based on a low gamma L and having the positive (+) polarity, a data voltage VL− generated based on the low gamma L and having a negative (−) polarity, and a data voltage VH− generated based on the high gamma H and having the negative (−) polarity. Referring to FIG. 4, in a temporal gamma mixing (TGM) scheme according to related art, a voltage gap between the data voltage VH+ and the data voltage VL+ is less than a voltage gap between the data voltage VH+ and the data voltage VL−. In this case, if the data voltage VH+ is outputted to a pixel in an N-th frame, where N is a natural number, a response speed when the data voltage VL+ is outputted to the pixel in an (N+1)-th frame is less than a response speed when the data voltage VL− is outputted to the pixel in the (N+1)-th frame.

Similarly, a voltage gap between the data voltage VH− and the data voltage VL− is less than a voltage gap between the data voltage VH− and the data voltage VL+. In this case, if the data voltage VH− is outputted to the pixel in the N-th frame, a response speed when the data voltage VL− is outputted to the pixel in the (N+1)-th frame is less than a response speed when the data voltage VL+ is outputted to the pixel in the (N+1)-th frame.

Similarly, the voltage gap between the data voltage VL+ and the data voltage VH+ is less than the voltage gap between the data voltage VL+ and the data voltage VH−. In this case, if the data voltage VL+ is outputted to the pixel in the N-th frame, a response speed when the data voltage VH+ is outputted to the pixel in the (N+1)-th frame is less than a response speed when the data voltage VH− is outputted to the pixel in the (N+1)-th frame.

Similarly, the voltage gap between the data voltage VL− and the data voltage VH− is less than the voltage gap between the data voltage VL− and the data voltage VH+. In this case, if the data voltage VL− is outputted to the pixel in the N-th frame, a response speed when the data voltage VH− is outputted to the pixel in the (N+1)-th frame is less than a response speed when the data voltage VH+ outputted to the pixel in the (N+1)-th frame.

In other words, in a TGM scheme according to the related art, a difference of data voltages between consecutive frames is less if polarities of the consecutive frames are the same than if the polarities of the consecutive frames are different.

Figure 5A:
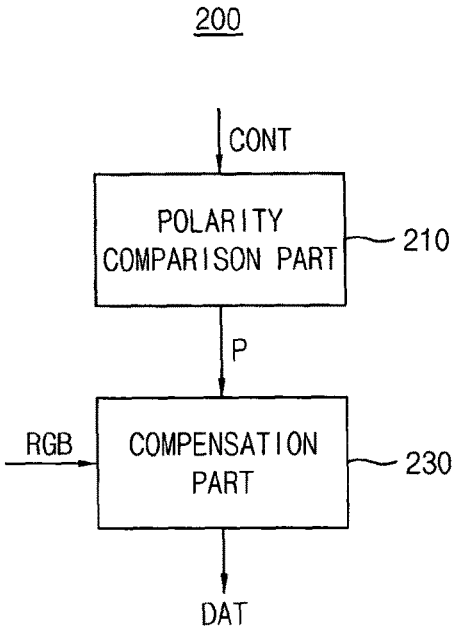
FIG. 5A is a block diagram of a timing controller according to exemplary embodiments.

FIG. 5A is a block diagram of a timing controller according to exemplary embodiments.

Referring to FIGS. 1, 2 and 5A, the timing controller 200 includes a polarity comparison part 210 and a compensation part 230.

According to an embodiment, the polarity comparison part 210 receives the input control signal CONT. The polarity comparison part 210 compares a first polarity of a first data voltage of the first pixel in the first frame 1F with a second polarity of a second data voltage of the first pixel in the second frame 2F based on the input control signal CONT. The polarity comparison part 210 outputs the result P of the comparison to the compensation part 230.

According to an embodiment, the compensation part 230 receives the result P of the comparison and the input image data RGB. The compensation part 230 compensates the second data voltage based on a first look-up table if the first polarity and the second polarity are the same. The compensation part 230 compensates the second data voltage based on a second look-up table if the first polarity and the second polarity are different.

The compensation part 230 may selectively perform an image quality compensation, a spot compensation, an adaptive color correction (ACC), and/or a dynamic capacitance compensation (DCC) on the input image data RGB to compensate the second data voltage based on the first look-up table or the second look-up table.

A difference between the first data voltage and the compensated second data voltage is greater than a difference between the first data voltage and the second data voltage, when the compensation part 230 compensates the second data voltage based on the first look-up table.

The difference between the first data voltage and the compensated second data voltage is less than the difference between the first data voltage and the second data voltage, when the compensation part 230 compensates the second data voltage based on the second look-up table.

According to an embodiment, the compensation part 230 generates the data signal DAT based on the compensated second data voltage. The compensation part 230 outputs the data signal DAT to the data driver 500.

A similar method may be applied to the second through fourth frames 2F~4F.

Figure 5B:
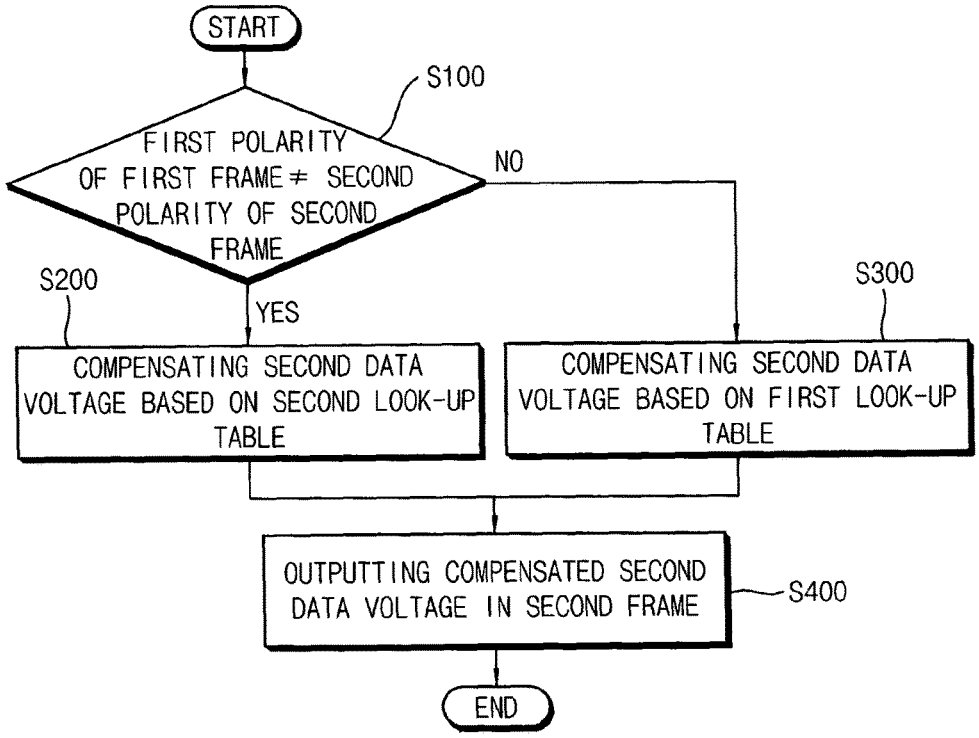
FIG. 5B is a flowchart of a method of driving a display apparatus included in a timing controller illustrated in FIG. 5A.

FIG. 5B is a flowchart of a method of driving a display apparatus included in a timing controller illustrated in FIG. 5A.

According to an embodiment, referring to FIGS. 1, 5A and 5B, the polarity comparison part 210 compares the first polarity of the first data voltage of the first pixel in the first frame with the second polarity of the second data voltage of the first pixel in the second frame S100. The compensation part 230 compensates the second data voltage based on the first look-up table if the first polarity and the second polarity are the same S300. The compensation part 230 compensates the second data voltage based on the second look-up table if the first polarity and the second polarity are different S200. The data driver 500 outputs the compensated second data voltage to the first pixel in the second frame S400.

Figure 6A:
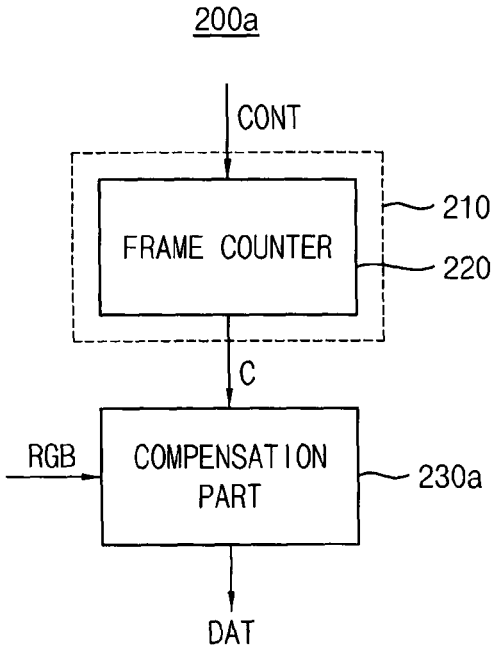
FIG. 6A is a block diagram of a timing controller according to exemplary embodiments.

FIG. 6A is a block diagram of a timing controller according to exemplary embodiments.

According to an embodiment, referring to FIGS. 1, 2 and 6A, the timing controller 200*a* includes a polarity comparison part 210 and a compensation part 230*a*. The polarity comparison part 210 includes a frame counter 220.

According to an embodiment, the frame counter 220 receives the input control signal CONT. The frame counter 220 determines whether the second frame is an odd-numbered frame or an even-numbered frame based on the input control signal CONT.

According to an embodiment, if polarities of data voltages corresponding to the first pixel are inverted for two frames and the polarities are inverted at transition times from even-numbered frames to odd-numbered frames, the frame counter 220 determines that the first polarity and the second polarity are different if the second frame 2F is an odd-numbered frame, and the frame counter 220 determines that the first polarity and the second polarity are the same if the second frame 2F is an even-numbered frame.

Alternatively, according to an embodiment, if the polarities of the data voltages corresponding to the first pixel are inverted for two frames and the polarities are inverted at transition times from the odd-numbered frames to even-numbered frames, the frame counter 220 determines that the first polarity and the second polarity are the same if the second frame 2F is an odd-numbered frame, and the frame counter 220 determines that the first polarity and the second polarity are different if the second frame 2F is an even-numbered frame.

The frame counter 220 outputs the result C of the comparison to the compensation part 230*a*.

According to an embodiment, the compensation part 230*a* receives the result C of the comparison and the input image data RGB. The compensation part 230*a* compensates the second data voltage based on a first look-up table if the first polarity and the second polarity are the same. The compensation part 230*a* compensates the second data voltage based on a second look-up table if the first polarity and the second polarity are different.

The compensation part 230*a* may selectively perform an image quality compensation, a spot compensation, an adaptive color correction (ACC), and/or a dynamic capacitance compensation (DCC) on the input image data RGB to compensate the second data voltage based on the first look-up table or the second look-up table.

A difference between the first data voltage and the compensated second data voltage is greater than a difference between the first data voltage and the second data voltage when the compensation part 230*a* compensates the second data voltage based on the first look-up table.

The difference between the first data voltage and the compensated second data voltage is less than the difference between the first data voltage and the second data voltage when the compensation part 230*a* compensates the second data voltage based on the second look-up table.

According to an embodiment, the compensation part 230*a* generates the data signal DAT based on the compensated second data voltage. The compensation part 230*a* outputs the data signal DAT to the data driver 500.

A similar method may be applied to the second through fourth frames 2F~4F.

According to an exemplary embodiment, when an inversion pattern has been previously defined, it can be determined by the frame counter whether or not the polarity is inverted without directly checking the inversion every frame.

Figure 6B:
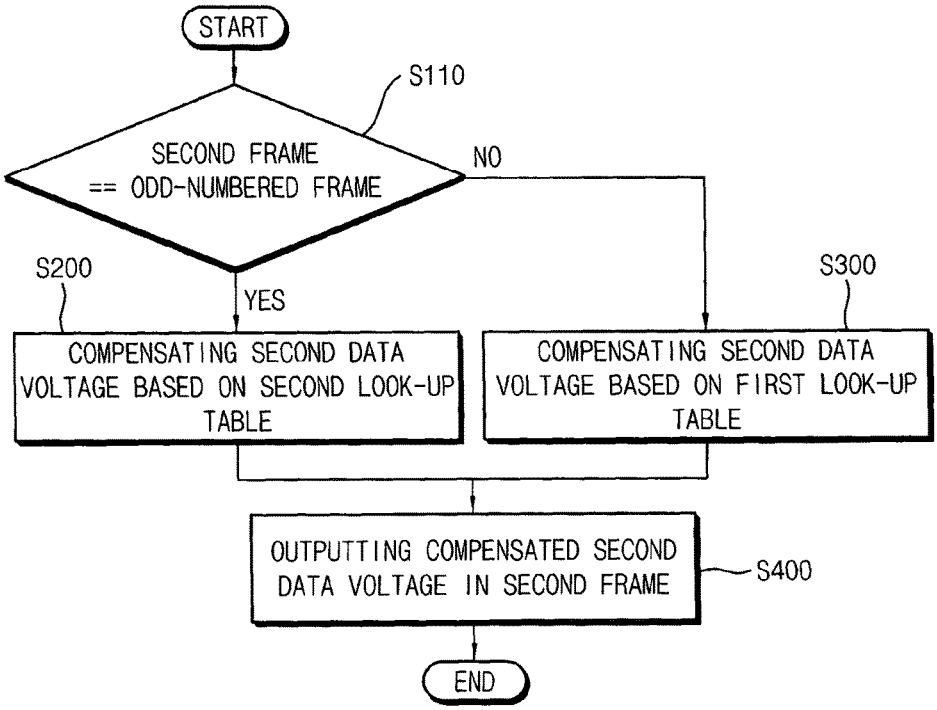
FIG. 6B is a flowchart of a method of driving a display apparatus included in a timing controller illustrated in FIG. 6A.

FIG. 6B is a flowchart of a method of driving a display apparatus included in a timing controller illustrated in FIG. 6A.

According to an embodiment, referring to FIGS. 1, 6A and 6B, the frame counter 220 determines whether the second frame is an odd-numbered frame or an even-numbered frame. By comparing with the previously defined inversion pattern, the frame counter 220 compares the first polarity of the first data voltage with the second polarity of the second data voltage S110. The compensation part 230*a* compensates the second data voltage based on the first look-up table if the first polarity and the second polarity are the same S300. The compensation part 230*a* compensates the second data voltage based on the second look-up table if the first polarity and the second polarity are different S200. The data driver 500 outputs the compensated second data voltage to the first pixel in the second frame S400.

The above described embodiments may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and features of the present inventive concept. Accordingly, all such modifications are intended to be included within the scope of embodiments of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A timing controller, comprising:

a polarity comparison part configured to compare a first polarity of a first data voltage with a second polarity of a second data voltage, the first data voltage corresponding to a first pixel in a first frame and generated based on a first gamma voltage, the second data voltage corresponding to the first pixel in a second frame and generated based on a second gamma voltage; and a compensation part configured to compensate the second data voltage based on a first look-up table if the first polarity is the same as the second polarity and compensate the second data voltage based on a second look-up table if the first polarity is different from the second polarity, wherein a difference between the first data voltage and the compensated second data voltage is greater than a difference between the first data voltage and the second data voltage, if the second data voltage is compensated based on the first look-up table.

2. The timing controller of claim 1, wherein the difference between the first data voltage and the compensated second data voltage is less than the difference between the first data voltage and the second data voltage, if the second data voltage is compensated based on the second look-up table.

3. The timing controller of claim 1, wherein a luminance of an image based on the first gamma voltage is equal to or greater than a luminance of an image based on a reference gamma voltage, and a luminance of an image based on the second gamma voltage is equal to or less than the luminance of the image based on the reference gamma voltage.

4. The timing controller of claim 3, wherein a composite gamma of the first and second gamma voltages is the same as the reference gamma voltage.

5. The timing controller of claim 1, wherein the first frame and the second frame are two consecutive frames.

6. The timing controller of claim 5, wherein the polarity comparison part comprises:

a frame counter configured to determine whether the second frame is an odd-numbered frame or an even-numbered frame.

7. The timing controller of claim 6, wherein the frame counter determines that the first polarity is different from the second polarity if the second frame is the odd-numbered frame and determines that the first polarity is the same as the second polarity if the second frame is the even-numbered frame.

8. A display apparatus comprising:

a display panel comprising a first pixel;

a timing controller comprising:

a polarity comparison part configured to compare a first polarity of a first data voltage with a second polarity of a second data voltage, the first data voltage corresponding to the first pixel in a first frame, the second data voltage corresponding to the first pixel in a second frame, wherein the first frame and the second frame are two consecutive frames, wherein the polarity comparison part includes a frame counter configured to determine whether the second frame is an odd-numbered frame or an even-numbered frame; and a compensation part configured to compensate the second data voltage based on a first look-up table if the first polarity is the same as the second polarity and compensate the second data voltage based on a second look-up table if the first polarity is different from the second polarity; and a data driver configured to output the first data voltage to the first pixel in the first frame and output the compensated second data voltage to the first pixel in the second frame.

9. The display apparatus of claim 8, wherein a difference between the first data voltage and the compensated second data voltage is greater than a difference between the first data voltage and the second data voltage, if the second data voltage is compensated based on the first look-up table.

10. The display apparatus of claim 8, wherein a difference between the first data voltage and the compensated second data voltage is less than a difference between the first data voltage and the second data voltage, if the second data voltage is compensated based on the second look-up table.

11. The display apparatus of claim 8, wherein the first data voltage was generated based on a first gamma voltage and the second data voltage was generated based on a second gamma voltage, a luminance of an image based on the first gamma voltage is equal to or greater than a luminance of an image based on a reference gamma voltage, and a luminance of an image based on the second gamma voltage is equal to or less than the luminance of the image based on the reference gamma voltage.

12. The display apparatus of claim 11, wherein a composite gamma of the first and second gamma voltages is substantially the same as the reference gamma voltage.

13. The display apparatus of claim 8, wherein the frame counter determines that the first polarity is different from the second polarity if the second frame is the odd-numbered frame and determines that the first polarity is the same as the second polarity if the second frame is the even-numbered frame.

14. A method of driving a display apparatus, the method comprising:

comparing a first polarity of a first data voltage with a second polarity of a second data voltage, the first data voltage corresponding to a first pixel in a first frame and generated based on a first gamma voltage, the second data voltage corresponding to the first pixel in a second frame and generated based on a second gamma voltage;

compensating the second data voltage based on a first look-up table if the first polarity is the same as the second polarity and compensating the second data voltage based on a second look-up table if the first polarity is different from the second polarity; and outputting the compensated second data voltage to the first pixel in the second frame, wherein a luminance of an image based on the first gamma voltage is equal to or greater than a luminance of an image based on a reference gamma voltage and a luminance of an image based on the second gamma voltage is equal to or less than the luminance of the image based on the reference gamma voltage.

15. The method of claim 14, wherein a difference between the first data voltage and the compensated second data voltage is greater than a difference between the first data voltage and the second data voltage, if the second data voltage is compensated based on the first look-up table.

16. The method of claim 14, wherein a difference between the first data voltage and the compensated second data voltage is less than a difference between the first data voltage and the second data voltage, if the second data voltage is compensated based on the second look-up table.

* * * * *